US006408486B1

(12) United States Patent
Saliba et al.

(10) Patent No.: US 6,408,486 B1
(45) Date of Patent: Jun. 25, 2002

(54) HINGE ASSEMBLY FOR A SECTIONAL DOOR

(75) Inventors: Sam Saliba; Mitch Billows; Gerhard Vogelgsang, all of Revesby (AU)

(73) Assignee: Evans Deakin Pty. Limited (AU)

( * ) Notice: Subject to any disclaimer, the term of this patent is extended or adjusted under 35 U.S.C. 154(b) by 0 days.

(21) Appl. No.: 09/647,312

(22) PCT Filed: Mar. 31, 1999

(86) PCT No.: PCT/AU99/00239

§ 371 (c)(1),
(2), (4) Date: Jan. 26, 2001

(87) PCT Pub. No.: WO99/50522

PCT Pub. Date: Oct. 7, 1999

(30) Foreign Application Priority Data

Mar. 31, 1998 (AU) ..... PP 2692

(51) Int. Cl.[7] ..... E05D 5/00; E05D 15/00

(52) U.S. Cl. ..... 16/382; 16/366; 16/368; 16/369; 16/387; 16/225; 16/252; 16/263; 16/270; 160/229.1

(58) Field of Search ..... 49/197, 198, 501; 160/229.1, 201; 16/382, 366, 368, 369, 387, 225, 252, 263, 270

(56) References Cited

U.S. PATENT DOCUMENTS

| | | | | | |
|---|---|---|---|---|---|
| 5,133,108 | A | * | 7/1992 | Esnault | 16/225 |
| 5,170,832 | A | * | 12/1992 | Wagner | 160/229.1 |
| 5,553,651 | A | * | 9/1996 | Olsen | 160/229.1 |
| 5,622,012 | A | * | 4/1997 | Schijf | 16/355 |
| 5,782,282 | A | * | 7/1998 | Chen | 160/229.1 |
| 5,782,283 | A | | 7/1998 | Kendall | 160/229.1 |
| 5,921,308 | A | * | 7/1999 | Martin | 160/229.1 |
| 5,927,369 | A | * | 7/1999 | Pedersen | 160/229.1 |
| 6,009,930 | A | * | 1/2000 | Jantachek | 160/229.1 |
| 6,015,003 | A | * | 1/2000 | Switzgable | 160/229.1 |

FOREIGN PATENT DOCUMENTS

| | | |
|---|---|---|
| EP | 0 825 320 A2 | 2/1998 |
| WO | WO90/14486 | 11/1990 |
| WO | WO94/24397 | 10/1994 |
| WO | WO96/33333 | 10/1996 |
| WO | WO97/02401 | 1/1997 |

* cited by examiner

*Primary Examiner*—Chuck Y. Mah
(74) *Attorney, Agent, or Firm*—Cesari and McKenna, LLP

(57) ABSTRACT

A hinge assembly includes a first member having a curved-shape abutment surface spaced about a pivot axis, and a second member having a second abutment, which is a complementary shape to the first abutment surface. A link connects the members in a manner such that articulate movement is enabled while preventing human fingers or other objects being pinched between the abutment surfaces. A primary application of such a hinge is in a sectional door which is formed of a plurality of elongate panels having abutment surfaces. A method of forming the hinge and the door panels and a method of assembling such a sectional door are also disclosed.

20 Claims, 5 Drawing Sheets

HINGE ASSEMBLY FOR A SECTIONAL DOOR

TECHNICAL FIELD

The present invention relates to a hinge assembly, which is particularly useful but not limited to use in a door of the type known to be used as a sectional garage door in homes and in commercial premises.

In particular, the present invention relates to an anti-pinch hinge and a sectional door which has a plurality of articulating panels, and which are joined in such a manner that the insertion of a persons's finger or other object between the panels is substantially precluded.

BACKGROUND OF THE INVENTION

Sectional overhead doors are commonly known to be used as garage doors in homes and other commercial premises. The doors are formed of a plurality of panels, which are commonly joined by hinges on the internal side of the door, such that the panels can pivot relative to each other as the door is raised or lowered along substantially L-shaped tracks provided on either side of the door, i.e. which extend from the floor to the ceiling and then towards the rear of the garage or other building.

In such sectional doors, there is the potential that a person's fingers or other objects may be pinched between adjacent panels, particularly as the panels traverse the curved transition section of the track.

Various approaches have therefore been taken in an attempt to incorporate anti-pinch features in such doors.

One such attempt is described in U.S. Pat. No. 5,522,466 by Willis J Mullet and Albert W Mitchell (assigned to Wayne Dalton Corporation). In the aforementioned prior art U.S. Patent, there is described an embodiment of a door comprising a plurality of panels, wherein one edge between adjacent panels has a substantially concave curvilinear surface in vertical cross-section in the closed position of the door, whilst an edge on an adjacent second panel has a substantially planar surface in vertical cross-section in the closed position of the door, extending angularly from substantially the outer surface of the panels. A hinge means is then provided on the back surface of the door to define a pivot access for pivotal movement between planar and varying angular orientations when moving between the open and the closed positions, whereby the concave surface and the planar surface are in proximate facing relation in a closed position, and then remain in close proximity during the entirety of the pivotal movement of the first and second panels. The concave surface is circular and centred about a point displaced substantially inwardly of the inner surface of the body portion of the panels.

The object of aforementioned prior art U.S. Pat. No. 5,522,466 is to preclude the insertion of a person's finger or other article from being provided between the panels. However, the configuration of the arrangement of U.S. Pat. No. 5,522,446 is somewhat complex in shape, expensive to manufacture, difficult to assemble and disassemble (for servicing, etc.), and would be easily damaged.

U.S. Pat. No. 5,495,640, also by Wayne Dalton discloses a device having adjacent panels, one having a substantially concave, curvilinear surface, the other having a planar surface. Rollers (122) are affixed to the panel assembly by means of a bracket assembly (11). The rollers (32) are offset from the door panels, and, in the transition track section (14) (see FIG. 3), the bracket substantially displaces the roller

(32) a substantial distance from the top panel (21). Due to the configuration of the panels (21), they are formed with trapezoidal ribs or struts (26,27) for increased rigidity and strength.

EP 0825320 by Windsor Doors provides a door panel mating assembly for making panels having one edge of concave shape and the other of convex shape. A hinge mechanism is provided whereby the hinge extends across the junction and having two end portions connected to the two panels for movement about a pivoting axis. The pivot axis is defined as being the origin of a coordinate place having coordinate axes defining four quadrants with a radius intersection point being at the third quadrant. A prime disadvantage of this embodiment is that there is still a pinch point created by the hinge whereby a person's fingers or other objects may be inserted.

WO 97/02401 by Cardo Doors discloses a plurality of door panels (12) interconnected by hinge means to pivot about axes (32, 34) which are centered between the side walls (28,30) of the panels (12). The hinge means having a convex member (20) and a concave member (18) forming a bearing face between adjacent panels (12). The convex member (20) is a 'separate component' in WO 97/02401. A locking member (58) (FIG. 7) is snapfitted into a recess to connect adjacent door panels. Whilst it uses a resilient hook (85) and a pivot shaft (40), the configuration is different to that of the Applicants.

U.S. Pat. No. 5,782,283 by Raynor discloses a pinch proof garage door having edges which are formed as an arc-shaped male portion 24 and an arc-shaped female portion 22 which cooperate so as to prevent insertion of a person's finger. A hinge leaf is attached to the rear side of the panels.

It will be appreciated that the various prior art devices all have their shortcomings. In particular, each of the prior art devices is relatively complex in design, and relatively difficult and expensive to manufacture and assemble.

SUMMARY OF THE INVENTION

The present invention seeks to overcome the disadvantages of the prior art by providing a sectional door in which, during articulation of it's panel sections, the insertion of a person's finger or other object is substantially precluded.

The present invention also seeks to provide a sectional door which, due to it's unique and simple design is inexpensive to manufacture, is easy to install, is quiet in operation, and is not prone to be easily damaged, consequently overcoming the disadvantages of prior art sectional doors.

In one broad form, the present invention provides A hinge assembly, including:

- a first hinge member having a substantially curved-shaped first abutment surface spaced about a pivot axis;
- a second hinge member having a second abutment surface being at least in part of complementary shape to said first abutment surface; and,
- a link means to pivotally connect said first and second hinge members in a manner so as to substantially prevent human fingers or other objects being pinched or otherwise provided between said abutment surfaces.

Preferably, said link means is separately formed so as to be attached to said first and second hinge members when assembling said hinge assembly.

Alternatively, but also preferably, said link means is integrally formed with said second hinge member.

In a preferred form, said first abutment surface is substantially semi-circular in shape.

Preferably, said pivot axis is embodied as an orifice through said first hinge member, which is adapted to align with a first orifice provided through said link means to receive a pivot pin therethrough.

Also preferably, said second hinge member is provided with an orifice therethrough which is adapted to align with a second orifice provided through said link means to receive a locking pin therethrough.

In a preferred embodiment, said pivot axis is spaced substantially equidistant between front and rear surfaces of said first hinge member.

Preferably, said second abutment surface is of complementary shape to only part, and preferably about half, of first abutment surface adjacent a front edge thereof.

Most preferably, said pivot pin is removable or releasable.

In a preferred form, said locking pin is removable or releasable.

In a further broad form, the present invention provides a hinge assembly, including:

a first hinge member having a substantially semi-circular shaped first abutment surface spaced about a pivot orifice;

a second hinge member having a second abutment surface being of complementary shape to said first abutment surface, and having a locking pin orifice therethrough;

a link member for releasably attaching said first and second hinge members, having a pair of orifices therethrough, a first of which is adapted to align with said pivot orifice and receive a pivot pin therethrough, and a second of which is adapted to align with said locking pin orifice and receive a locking pin therethrough;

such that, said first and second hinge members can pivot are relative to each other in a manner so as to substantially prevent human fingers or other objects being provided or pinched between said abutment surfaces.

In yet a further broad form, the present invention provides a sectional door having a plurality of elongate panels connected adjacent to one another and movable to allow the door too follow a curved track between a substantially vertical closed position and a substantially horizontal raised position, characterised in that each of said panels is formed with first and second abutment surfaces on the longitudinal edges of each said panel, wherein, in cross-section, said first abutment surface is of curved shape spaced about a pivot axis, and said second abutment surface is at least partly of complementary shape to said first abutment surface, and, whereby the complementary surfaces of adjacent panels are pivotally connected by a link means in a manner so as to substantially prevent human fingers or other objects being pinched or otherwise provided between said abutment surfaces.

Preferably, said abutment surfaces are adapted to receive first and second hinge members for attachment of said link means.

Also preferably, said hinge members are separately formed and then attached adjacent the abutment surfaces of said panels in either a permanent or removable manner.

Perhaps most preferably, said hinge members are moulded or cast of plastics.

Also preferably, said hinge members are secured to bracing members which are then transversely connected between the longitudinal edges of said panels.

Most preferably, said hinge members are permanently or releasably secured to said bracing members by means of a snap-fit connection, by screws, or the like.

In a preferred form, said bracing members are made of steel or other metal.

Preferably, said link means is separately formed so as to be attached to said first and second hinge members when assembling said sectional door.

Also preferably, said link means is integrally formed with one of said hinge members.

Most preferably, said first abutment surface is substantially semi-circular in shape.

In its preferred form, said first pivot axis is embodied as an orifice through a first of said hinge members, and is adapted to align with a first orifice provided through said link means to receive a pivot pin there through.

Also, in its preferred form, a second of said hinge members is provided with an orifice there through which is adapted to align with a second orifice provided through said link means and provided with a locking pin therethrough.

Preferably, said pivot axis is spaced substantially equidistant between front and rear surfaces of said panels.

Most preferably, said second abutment surface is of complementary shape to only part, and preferably about half, of said first abutment surface adjacent a front surface thereof.

In a preferred form, said pivot pin is removable or releasable.

Also preferably, said locking pin is removable and releasable.

In a preferred embodiment, said panels are formed of sheet steel, aluminium or other sheet metal.

In a further broad form, the present invention provides a sectional door having a plurality of elongate panels connected closely adjacent to one another and moveable to allow the door to follow a curved track between a substantially vertical closed position and a substantially horizontal raised position, characterised in that each of said panels is formed with first and second abutment surfaces on the longitudinal edges of each said panel, wherein, in cross-section, said first abutment surface is of substantially curved, such as semi-circular shape about a pivot orifice, and said second abutment surface is of complementary shape spaced from a locking pin orifice, whereby complementary surfaces of adjacent panels are releasably attached by provision of at least one link member which has a pair of orifices therethrough, a first of which is adapted to align with said pivot orifice and receive a pivot pin therethrough, and a second of which is adapted to align with said locking pin orifice and receive a locking pin therethrough.

Preferably, rollers for mounting and permitting movement of said panels within said track are supported within each said pivot axis positioned at the ends of the first abutment surface of each panel.

In yet a further broad form, the present invention provides a method of forming a door panel for a sectional door, including the steps of:

forming a door panel skin having first and second abutment surfaces on the longitudinal surfaces of the skin wherein said first abutment surface is curved, such as substantially semi-circular in shape, and said second abutment surface is of complementary shape;

connecting first and second hinge members to the ends of transverse brace members, and then attaching at least a pair of transverse brace member between said first and second abutment surfaces;

characterised in that each respective said first hinge member is adapted to be linked to a respective one of each said second hinge member in a manner so as to prevent human fingers or other objects being pinched or otherwise being provided between said abutment surfaces.

In yet a further broad form, the present invention provides a method of assembling a sectional door, including the steps of:

providing a plurality of elongate panels, each panel having first and second abutment surfaces on the longitudinal edges of each panel wherein said first abutment surface is curved, such as substantially semi-circular in shape, and said second abutment surface is of complementary shape;

connecting adjacent panels via at least one link means to allow pivotal movement there between;

characterised in that each said link means connects adjacent panels in a manner so as to prevent human fingers or other objects being pinched or otherwise provided between said abutment surfaces.

BRIEF DESCRIPTION OF THE DRAWINGS

The present invention will become more fully understood from the following detailed description of the preferred but non-limiting embodiment thereof, described in connection with the accompanying drawings, wherein.

DETAILED DESCRIPTION OF PREFERRED EMBODIMENTS

Throughout the drawings, like numerals will be used to identify similar features, except where expressly otherwise indicated.

As will be appreciated by persons skilled in the art, a sectional door of the overhead rolling type, comprises a plurality of articulating door panels joined by hinges.

Figure 1:
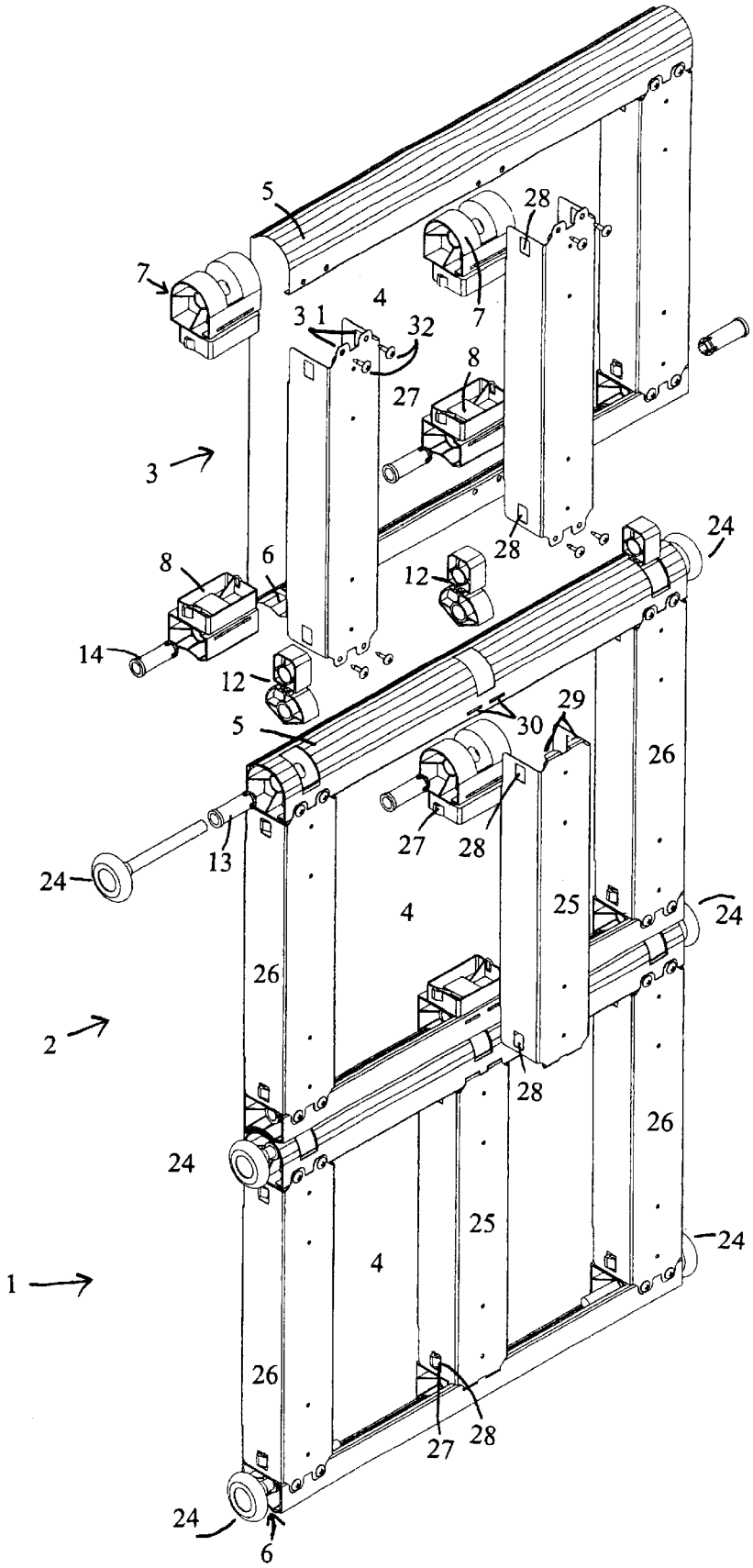
FIG. 1 illustrates an isometric partly-exploded view of a series of door panels, which form a sectional door in accordance with the present invention.

FIG. 1 details a partly exploded isometric view of a series of three such door panels, 1, 2 and 3. Each door panel 1, 2 and 3, has a skin 4, which is typically fabricated of aluminium or other sheet metal, and which is formed with first and second shaped abutment surfaces 5 and 6 on the upper and lower longitudinal edges of each panel, 1, 2 and 3. A more detailed isometric view of the skin is shown in FIG. 4(*a*), whilst a profile view of the skin in shown in FIG. 4(*b*).

Figure 4A:
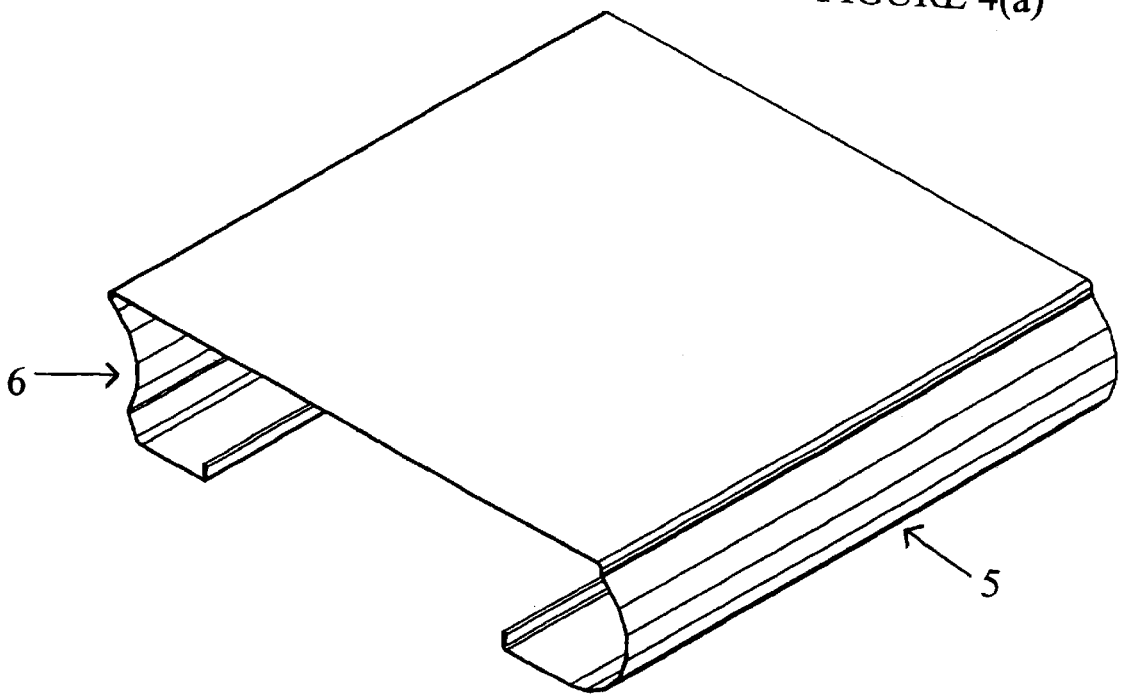
Figure 4B:
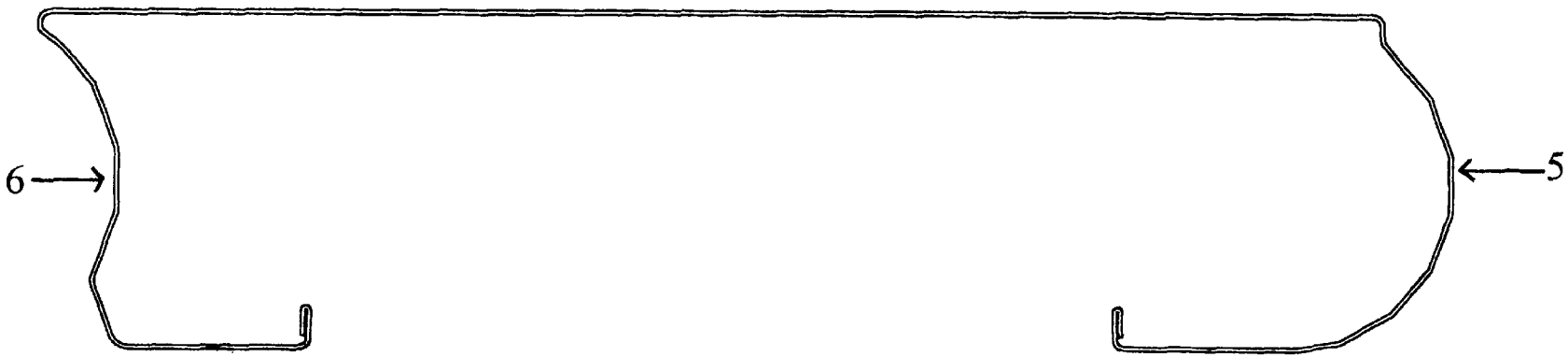

As will be more clearly seen from FIGS. 4(*a*) and 4(*b*), the first abutment surface 5 is of curved shape, and in particular, is preferably of substantially semi-circular shape. The second abutment surface 6 is at least partly of complementary shape to the first abutment surface 5. Each panel 1, 2 and 3 is provided with upper and lower hinge members 7 and 8 respectively.

Figure 2A:
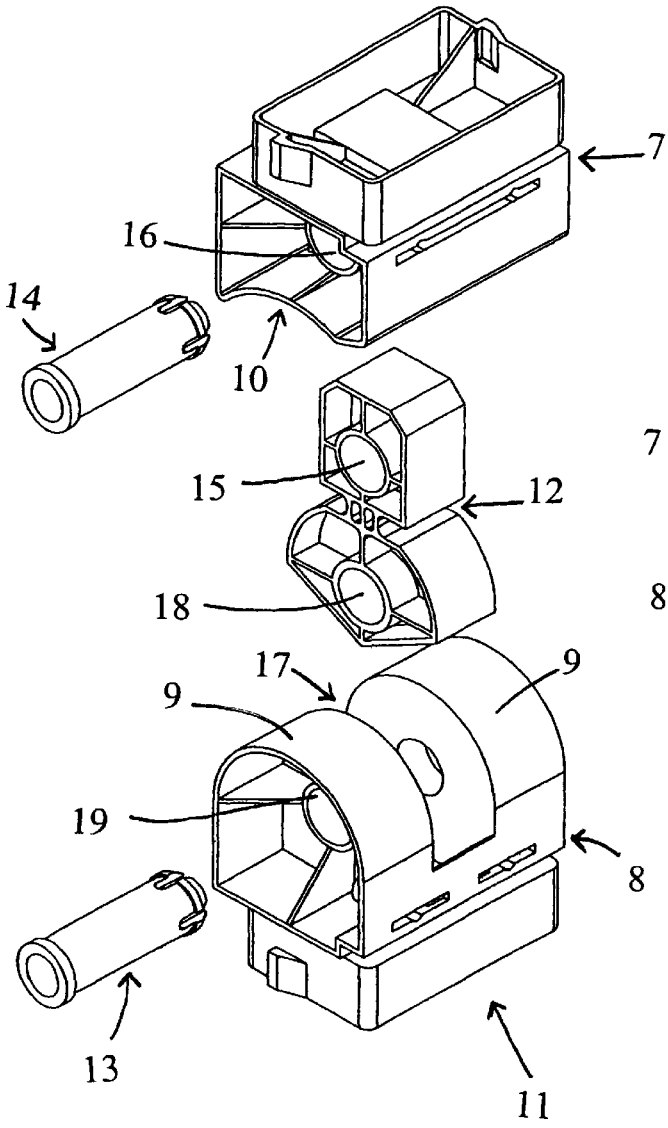
FIG. 2 shows, in FIGS. 2(*a*) and 2(*b*), exploded and assembled views, respectively, of the hinge assembly of the present invention.
Figure 2B:
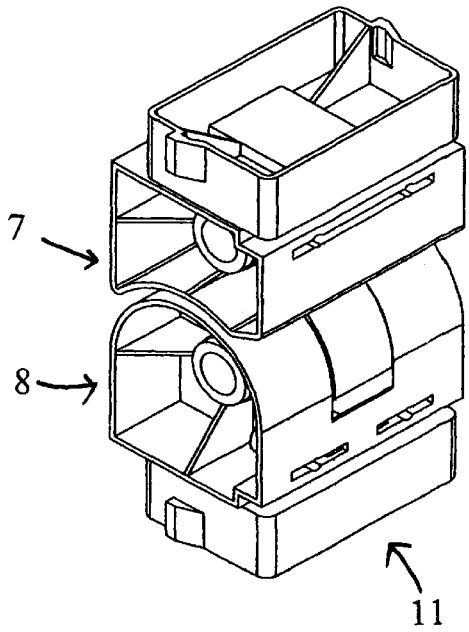

Details of the hinge components are shown in FIG. 2, with FIG. 2(*a*) illustrating an exploded isometric view of the hinge assembly, whilst FIG. 2(*b*) illustrates a connected view of the hinge components. As seen in FIGS. 2(*a*) and 2(*b*). The hinge members 7 and 8 are also of complementary shape, with the first hinge member, connected to the upper longitudinal edge of each panel, having a concavely shaped surface 9, whilst the second hinge member, which is the hinge member connected to the lower longitudinal edge of each panel, is provided with a complementary shaped or convexly shaped surface 10. The concave and convexly shaped surfaces 9 and 10 are shaped such that they remain proximate to one another during articulation of the hinge assembly, to substantially preclude the insertion of person's finger or other object between adjacent panels 1, 2 and 3.

Various other components of the hinge assembly, generally designated by the numeral 11, in FIGS. 2(*a*) and 2(*b*), include the link member 12, a pivot pin 13, and a locking pin 14.

It will be understood that to assemble the hinge, such that articulation is enabled, the link 12 may be inserted into hinge component 7, such that orifices 15 and 16 are aligned, and then pin 14 is inserted through the aligned orifices. Similarly, the link member 12 is supplied into cutout 17 of hinge component 8, such that orifices 18 and 19 align, and then pivot pin 13 is inserted therethrough. The assembled hinge assembly is shown in FIG. 2(*b*).

Figure 3:
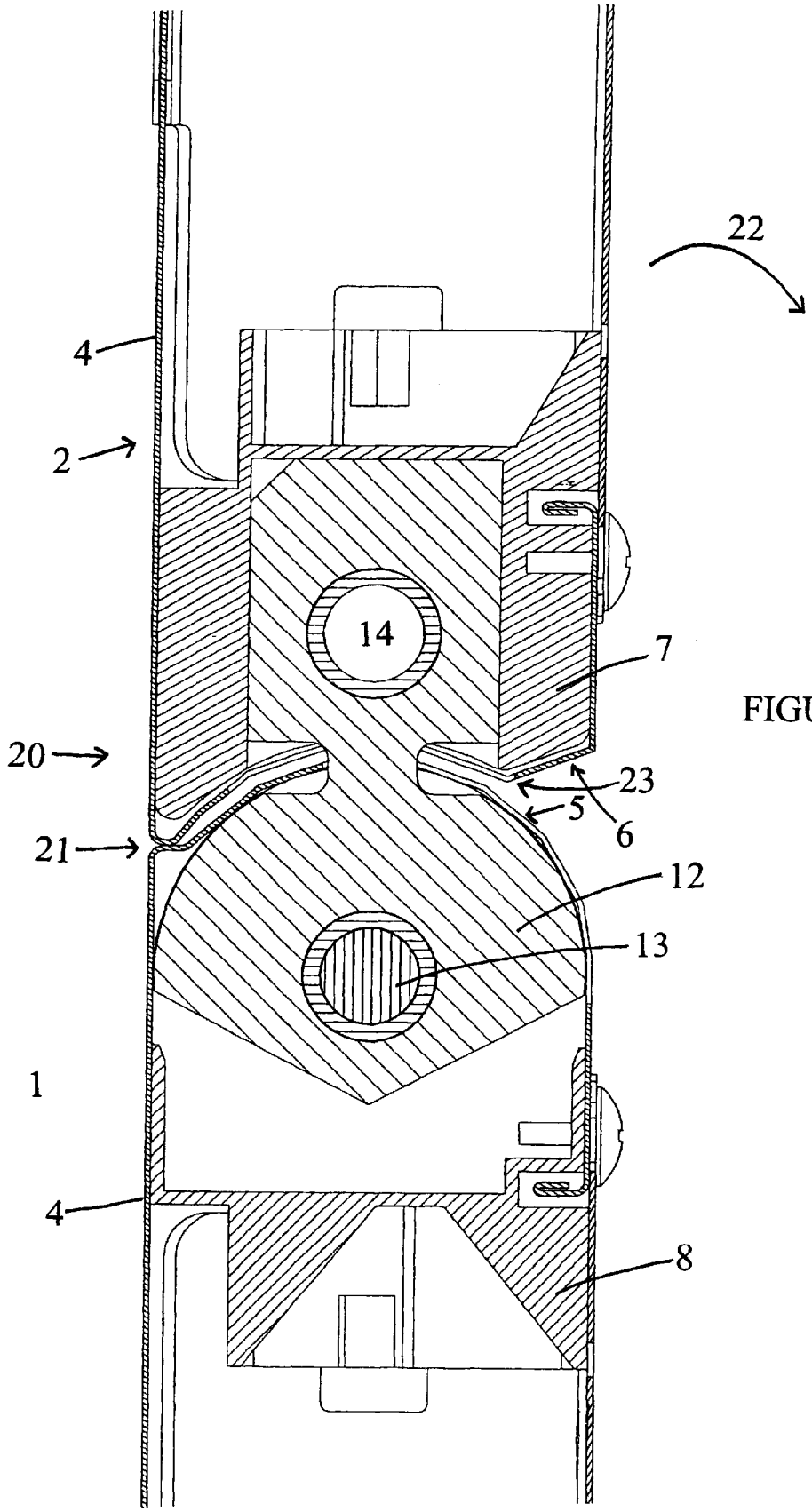
FIG. 3 shows a cross sectional view of the hinge components of FIG. 2; and, FIG. 4 shows, in FIGS. 4(*a*) and 4(*b*), isometric and profile views, of the skin of the door panel of the present invention.

FIG. 3 illustrates a cross-sectional view of the assembled hinge assembly, when used in a pair of panels. It will be understood that the front surface of a door formed by a plurality of adjacent panels is a substantially planar surface when viewed in the direction of arrow 20, having essentially little or no gap between adjacent panels 4, such that insertion of a person's finger or object therein is substantially precluded. As the panels articulate, which may be illustrated by the upper panel 2 moving in the direction of arrow 22, in FIG. 3, it will be understood that with the configuration shown , angular rotation of 90° is easily enabled, whilst ensuring that minimal gap 21 is created as the panels articulate one to the other. The termination 23 on the rear side of the concave surface 6 is enabled to ensure a wider angle for articulation of the panels. It will be appreciated that a greater or lesser severe termination 23 may be used, depending upon the angular articulation requirements of adjacent panels.

It will be appreciated that the hinge members 7 and 8 may be formed integrally with sheet members 4, or they may be separately constructed and then fitted into panels 4. In preference, however, the hinge components illustrated in FIG. 2 are preferably formed of plastics material, whilst the skins 4 are preferably formed of sheet steel, aluminium or other sheet material. Such a configuration ensures that the exposed component, being the aluminium panels, is weather resistant, etc., when used for a sectional overhead garage door, whilst the plastic hinge assembly components may be easily connected with the skin as will be described hereafter, and also assist in the reduction of noise in operation of such a door assembly.

It will further be understood that in the assembly of the hinge assembly, as shown in FIGS. 2(*a*) and 2(*b*), the link member 12 may be integrally formed with the hinge member 7, consequently eliminating the need for the pin 14, that is, the hinge member 7 could be formed with an arm extending therefrom having the orifice 18 therethrough.

The pivot axis formed by the connection of orifice 19 and pivot pin 13 is shown to be substantially equidistantly spaced from the sides of the hinge component 8, with the abutment surface 9 spaced thereabouts. Such an arrangement is unique in comparison to the prior art, whereby various panels are connected by means of a hinge placed external to the rear surface of the panel.

The pins 13 and 14 are shown having snap fit type ends thereon, such that they can be easily inserted into the orifices and retained therein but can be removed or released, if desired.

By utilising the hinge in accordance with the present invention, a sectional door having a plurality of elongate panels connected adjacent to one another, will permit the door to follow a curved track between the substantially closed position and the substantially horizontal raised position. Movement of the door is effected by means of roller 24, as shown in FIG. 1, which fit within the guide track which is assembled adjacent to the door frame.

Bracing members 25, otherwise known as styles or muntons by persons skilled in the art, which are positioned intermediate the ends of the door panel and end bracing members 26 are also shown in FIG. 1. It will be seen that the bracing members 25 and 26 are substantially identical except for the means by which they are connected to the skins. Prior to connection of the bracing members 25 and 26 to the skin, the hinge members may be snapfitted into the ends of the bracing members by means of snap fit connections 27 fitting into cutouts 28. The bracing members, preferably being constructed of steel, are therefore supplied with the hinge members 7 and 8, and then the bracing members are supplied on to the skin 4. The intermediate bracing members 25, having tabs 29 are connected by means of insertion of the tabs 29 into slits 30. The end bracing members 26 are manufactured identically to the bracing members 25, with the exception that the ends are not deformed to form the tabs 29. Rather, they are merely supplied with screw holes 31, into which screws 32 are provided. It will be appreciated that the provision of tabs 29 facilitate the quick and easy assembly of the door panels, whilst still providing additional strength, as required. If extra securement is considered necessary or desirable, then screws may alternatively be used as shown in the upper panel 3 in the drawing. Likewise, the end bracing members 26 may alternatively be simply connected to the panels by means of tabs, if desired.

A further aspect of the present invention relates to the manner in which the door panels are assembled. Obviously, it will be appreciated that by prefabricating each panel incorporating its hinges and bracing members, a door may be quickly assembled by means of easily connecting a plurality of adjacent panels by supplying the link member 12 and then the pins 13 and 14 at the assembly site. As such, installation of the door by the on-site installer is very quick and easy.

It will be appreciated that the design of the panels, and particularly the longitudinal edges thereof, in combination with the hinge assembly, is much simpler than the arrangement shown in the prior art documentation, whilst still achieving the object of precluding the insertion of a person's finger or other object between the panels.

Consequently, the panels of the present invention are much less expensive to manufacture, but also, due to their less complex shape, are much more sturdy and less prone to damage during operation. Operation of the door of the present invention is also very quiet. It will also be appreciated that the sectional door may be easily assembled in-situ upon installation of the door by simple provision of the sections adjacent one another, and by insertion of the link pivot pins therebetween.

The present invention has been hereinbefore described with reference to a particular embodiment. It will be appreciated that numerous variations and modifications will become apparent to persons skilled in the art. All such variations and modifications should be considered to fall within the scope of the invention as broadly hereinbefore described and as hereinafter claimed.

What is claimed is:

1. A hinge assembly, including:

a first hinge member having front and rear surfaces and a substantially semi-circular shaped first abutment surface spaced substantially equiradially about a substantially centrally provided pivot orifice;

a second hinge member having a second abutment surface being substantially of complementary shape to mate with said first abutment surface, and having a locking pin orifice therethrough;

a link member for releasably attaching said first and second hinge members and having a pair of orifices therethrough, the first of which is adapted to align with said pivot orifice and receive a pivot pin therethrough and a second of which is adapted to align with said locking pin orifice and receive a locking pin therethrough;

such that, said first and second hinge members can pivot relative to each other in a manner whereby said abutment surfaces are maintained substantially proximal to one another so as to substantially prevent human fingers or other objects being provided or pinched between said abutment surfaces.

2. A hinge assembly including:

a first hinge member having front and rear surfaces and a substantially semi-circular shaped first abutment surface spaced substantially equiradially about a substantially centrally provided pivot orifice;

a second hinge member having a second abutment surface being substantially of complementary shape to mate with said first abutment surface;

a link member integral to said second hinge member for releasably attaching said first and second hinge members, said link member having a first orifice therethrough which is adapted to align with said pivot orifice and receive a pivot pin therethrough;

such that, said first and second hinge members can pivot relative to each other in a manner whereby said abutment surfaces are maintained substantially proximal to one another so as to substantially prevent human fingers or other objects being provided or pinched between said abutment surfaces.

3. A hinge assembly as claimed in claim 1 or 2, wherein said pivot orifice is spaced substantially equidistant between said front and rear surfaces of said first hinge member.

4. A hinge assembly as claimed in claim 1 or 2, wherein said second abutment surface has a smaller area than the first abutment surface.

5. A hinge assembly as claimed in claim 1 or 2, and including a removable pivot pin received in the pivot pin orifice and the first orifice of the link member.

6. A hinge assembly as claimed in claim 1 and including a removable locking pin in the locking pin orifice and the second orifice of the link member.

7. A sectional door having a plurality of elongate panels connected adjacent to one another and movable to allow the door to follow a curved track between a substantially vertical closed position and a substantially horizontal raised position, each of said panels being formed with first and second abutment surfaces on the longitudinal edges of each said panel, wherein, in cross-section, said first abutment surface is of substantially semi-circular shape and said second abutment surface is of substantially complementary shape to said first abutment surface, wherein the complementary surfaces of adjacent panels are pivotally connected by one or more hinge assemblies, each hinge assembly, including:

a first hinge member associated with said first abutment surface of said panel, said first hinge member having a substantially semi-circular shaped first abutment surface spaced substantially equiradially about a centrally provided pivot orifice;

a second hinge member associated with said second surface of said panel, said second hinge member having a second surface being substantially of complementary shape to mate with said first surface of said first hinge member, and having a locking pin orifice therethrough;

a link member for releasably attaching said first and second hinge members and having a pair of orifices therethrough, the first of which is adapted to align with said pivot orifice and receive a pivot pin therethrough, and a second of which is adapted to align with said locking pin orifice and receive a locking pin therethrough;

such that, said adjacent panels can pivot relative to each other in a manner whereby the abutment surfaces are maintained substantially proximal to one another so as to substantially prevent human fingers or other objects being provided or pinched between said abutment surfaces.

8. A sectional door as claimed in claim 7, wherein said hinge members are separately formed and then attached to the respective abutment surfaces of said panels in either a permanent or removable manner.

9. A sectional door as claimed in claim 7 or 8, wherein said hinge members are molded or cast of plastics.

10. A sectional door as claimed in claim 7 or 8, wherein said hinge members are secured to bracing members which are then transversely connected between the longitudinal edges of said panels.

11. A sectional door as claimed in claim 10, wherein said hinge members are secured to said bracing members by fasteners.

12. A sectional door as claimed in claim 10, wherein said bracing members are made of metal.

13. A sectional door as claimed in claim 7 or 8, wherein said link member is separately formed so as to be attached to said first and second hinge members when assembling said sectional door.

14. A sectional door as claimed in claim 7 or 8, wherein said second abutment surface has a smaller area than said first abutment surface.

15. A sectional door as claimed in claim 7 or 8, and including a removable pivot pin in the pivot pin orifice and the first orifice of the link member.

16. A sectional door as claimed in claim 7 or 8, and including a removable locking pin in said locking pin orifice and the second orifice of the link member.

17. A sectional door as claimed in claim 7 or 8, wherein said panels are formed of metal.

18. A sectional door as claimed in claim 7 or 8, wherein rollers for mounting and permitting movement of said panels within said track are associated with each said pivot pin positioned at the ends of the first abutment surface of each panel.

19. A method of forming a door panel for a sectional door, including the steps of:

forming a door panel skin having first and second abutment surfaces on the longitudinal surfaces of the skin wherein said first abutment surface is substantially semi-circular in shape, and said second abutment surface is of complementary shape to mate with a first abutment surface of an adjacently connected panel;

connecting first and second hinge members to the ends of a pair of transverse brace members, and then attaching said pair of transverse brace members between said first and second abutment surfaces;

wherein each respective said first hinge member is adapted to be linked to a respective one of each said second hinge member by a link member, which extends from said second hinge member and has an orifice therethrough, said orifice being adapted to align with a substantially centrally positioned pivot orifice provided in said first hinge member, such that a pivot pin is then provided through the aligned orifices, whereby said abutment surfaces pivot in a substantially proximal manner so as to prevent human fingers or other objects being pinched or otherwise being provided between said abutment surfaces.

20. A method of assembling a sectional door, including the steps of:

providing a plurality of elongate panels, each panel having first and second abutment surfaces on the longitudinal edges of each panel wherein said first abutment surface is substantially semi-circular in shape, and said second abutment surface is of complementary shape adapted to mate with a first abutment surface of an adjacently connected panel;

connecting adjacent panels utilizing one or more hinge assemblies, each hinge assembly, including;

a first hinge member associated with said first abutment surface of said panel, said first hinge member having a substantially semi-circular shaped first abutment surface spaced substantially equiradially about a substantially centrally provided pivot orifice;

a second hinge member associated with said second surface of said panel, said second hinge member having a second surface being substantially of complementary shape to mate with said first surface of said first hinge member, and having a locking pin orifice therethrough;

a link member for releasably attaching said first and second hinge members and having a pair or orifices therethrough, the first of which is adapted to align with said pivot orifice and receive a pivot pin therethrough, and a second of which is adapted to align with said locking pin orifice and receive a locking pin therethrough;

wherein said panels are connected to pivot relative to each other in a manner whereby the abutment surfaces are maintained substantially proximal to one another so as to substantially prevent human fingers or other objects being provided or pinched between said abutment surfaces.

* * * * *